US005277681A

United States Patent [19]

Holt

[11] Patent Number: 5,277,681

[45] Date of Patent: Jan. 11, 1994

[54] STRETCHING EXERCISE MACHINE

[75] Inventor: Laurence E. Holt, Enfield, Canada

[73] Assignee: Parrsboro Metal Fabricators Limited, Nova Scotia, Canada

[21] Appl. No.: 924,919

[22] Filed: Aug. 5, 1992

[51] Int. Cl.[5] ..... A63B 21/00

[52] U.S. Cl. ..... 482/112; 482/133; 482/138; 482/142; 482/901; 128/25 R

[58] Field of Search ..... 482/111, 112, 113, 128, 482/131, 148, 907; 128/25; 73/379.01, 379.09

[56] References Cited

U.S. PATENT DOCUMENTS

| | | | |
|---|---|---|---|
| 3,374,675 | 3/1968 | Keropian | 128/25 R |
| 3,902,480 | 9/1975 | Wilson | 128/25 R |
| 3,992,004 | 11/1976 | Feron et al. | 272/141 |
| 4,063,726 | 12/1977 | Wilson | 272/130 |
| 4,089,330 | 5/1978 | Nicolosi et al. | 128/25 R |
| 4,185,818 | 1/1980 | Brentham | 272/130 |
| 4,226,415 | 10/1980 | Wright | 272/130 |
| 4,240,627 | 12/1980 | Brentham | 272/130 |
| 4,402,505 | 9/1983 | Young | 272/130 |
| 4,531,730 | 7/1985 | Chenera | 272/144 |
| 4,619,454 | 10/1986 | Walton | 272/141 |
| 4,647,040 | 3/1987 | Ehrenfried | 272/126 |
| 4,660,828 | 4/1987 | Weiss | 272/138 |
| 4,666,149 | 5/1987 | Olschansky et al. | 272/116 |
| 4,678,187 | 7/1987 | Prsala | 272/144 |
| 4,746,115 | 5/1988 | Lahman | 272/130 |
| 4,750,741 | 6/1988 | Smolanovich | 482/907 |
| 4,757,993 | 7/1988 | Rake | 272/142 |
| 4,795,150 | 1/1989 | Harlan | 272/144 |
| 4,819,936 | 4/1989 | Muller | 482/131 |
| 4,826,158 | 5/1989 | Fields, Jr. | 272/144 |
| 4,846,466 | 7/1989 | Stima, III | 272/130 |
| 4,865,315 | 9/1989 | Paterson et al. | 272/130 |
| 4,877,239 | 10/1989 | Dela Rosa | 272/126 |
| 4,969,643 | 11/1990 | Kroeker et al. | 482/111 |
| 4,976,426 | 12/1990 | Szabo et al. | 482/111 |
| 4,979,735 | 12/1990 | Stewart | 482/111 |
| 5,058,887 | 10/1991 | Patterson | 482/113 |

FOREIGN PATENT DOCUMENTS

| | | | |
|---|---|---|---|
| 1203822 | 4/1986 | Canada | 273/78 |
| 1262465 | 10/1989 | Canada | 273/77 |

*Primary Examiner*—Richard J. Apley
*Assistant Examiner*—Jeanne M. Mollo
*Attorney, Agent, or Firm*—Leydig, Voit & Mayer

[57] ABSTRACT

An exercise machine to stretch one or more muscle groups or joints of a body part, has at least one engagement member pivotally mounted on the frame to engage a body part associated with the muscle group or joint that is to be stretched and to position such part at a desired location. The engagement member is pivotally displaceable through a predetermined range of movement with respect to the frame. Movement in a first direction is effective to apply a stretching force to the associated muscle group. Movement of the engagement member in the first direction is done through a linear actuator. An angle indicator provides a readout of the position of said engagement member in the range. At any selected position in the range the engagement member can be blocked against movement in a direction opposite to the first direction and the force exerted by said body part upon the engagement member in the second direction is measured.

20 Claims, 12 Drawing Sheets

STRETCHING EXERCISE MACHINE

FIELD OF THE INVENTION

The present invention relates to an exercise machine for stretching one or more muscle groups or joints of a body part in order to improve the flexibility of the body part.

BACKGROUND OF THE INVENTION

The importance of physical fitness is increasingly being stressed in today's society. However, due to time constraints imposed by today's lifestyles as well as limited space for performing outdoor activities, more and more people are turning to health facilities to exercise. These facilities usually have exercise equipment such as rowing machines, stationary bicycles, stair machines, and treadmills. The majority of equipment available is designed for strengthening muscles and for increasing aerobic capacity. Machines to stretch muscles and thus to increase flexibility are generally not well represented at most health clubs. Increasing flexibility is important to reduce injuries due to tearing of muscles tissues; to increase the range of motion when doing a specific activity; to promote muscle relaxation; and to increase metabolism in muscles, joints and associated connective tissues. Exercises to increase flexibility are also used in the treatment of paralysis, orthopaedic problems and neuromuscular disabilities.

Machines that increase flexibility in the groin and quadracept muscles are described in U.S. Pat. No. 4,647,040 (Ehrenfried), U.S. Pat. No. 4,619,454 (Walton) and U.S. Pat. No. 4,826,158 (Fields). These devices are intended to improve flexibility by spreading apart the users legs into a split position.

U.S. Pat. No. 4,877,239 (Gregario Del Rosa) describes a thigh muscle stretching device wherein the muscles are stretched by spreading apart the users legs via a pair of elongated rod members which operate using a crank and worm gear mechanism.

U.S. Pat. No. 4,819,936 (Mueller) and U.S. Pat. No. 4,750,741 (Smalanovich) describe machines for stretching the back.

These prior art devices generally apply a force to the users limbs or body parts to spread them apart, which can cause injury. Also these devices do not provide any feedback as to the position of the body part being stretched or the force exerted on the muscle so that the exercise can be accurately repeated and the degree of stretching can be safely increased.

Exercises to increase flexibility that do not require an exercise machine have been described by the present invention in "Scientific Stretching for Sport (3S) Method" Laurence E. Holt, Sports Research Limited, 1974. The 3S method involves stretching a body part, containing a muscle group to be stretched, to its maximum stretched position, and then attempting to push the body part in the opposite direction. This effort is resisted by a partner who does not permit the body part to move, thus causing an isometric contraction. After a given time interval, the isometric contraction is stopped and the opposite muscle group is contracted (concentric contraction) to stretch the body part to a position which is further than the initial starting position. However, disadvantages of this method are that a partner of equal or greater strength is required, and accurate repeatability of the exercise is difficult. If the partner does not adhere to the 3S methodology, an injury may result.

SUMMARY OF THE INVENTION

It is an aim of the present invention to provide a series of exercise machines to replace the partner, and in a more controlled manner allow an individual to stretch a number of muscle groups or joints of a body part to increase flexibility in these body parts.

The present invention provides an exercise machine to stretch one or more muscle groups or joints of a body part, comprising: a frame; at least one engagement member movably mounted on said frame to engage a body part associated with the muscle group or joint that is to be stretched and to position such part at a desired location; each said engagement member being displaceable through a predetermined range of movement with respect to said frame, movement in a first direction in said range being effective to apply through said body part a stretching force to the associated muscle group; angle indicator means to provide a readout of the position of said engagement member in said range; power means to effect movement of said engagement means in said first direction; blocking means engageable at and selected position in said range to support said engagement means against movement in a second direction opposite to said first direction; and force measuring means operable when said blocking means is engaged to measure the force exerted by said body part upon said engagement member in said second direction.

To use the exercise machine, a user positions the body part to be stretched against a movable engagement member of the exercise device which can be positioned at a selected location in a given range of motion. The user selects a position that provides maximum stretching of the muscle group or joint. The user then tries to contract the muscle group (isometric contraction) but the machine blocks this movement. After a given time inter val, say 6 seconds (a number of protocols can be effective), the isometric contraction is stopped and the user contracts the opposite muscle group (concentric contraction) to move the body part to a further stretching position. This may be assisted by light pressure from the machine if desired. The exercise is repeated at the new lengthened position.

The exercise machine of the present invention provides means to monitor the degree of stretching of the body par by measuring the angular position of the body part in the movable member. This allows the user to monitor his progress and safely repeat the exercise at a later date.

The exercise machine also provides means to measure the force exerted by the user when performing the isometric contraction. This also allows the user to exercise safely and to monitor his progress.

Therefore, the present invention provides an exercise machine for improving flexibility that assists, controls and provides feedback to the user.

DETAILED DESCRIPTION OF THE PREFERRED EMBODIMENTS

Figure 1:
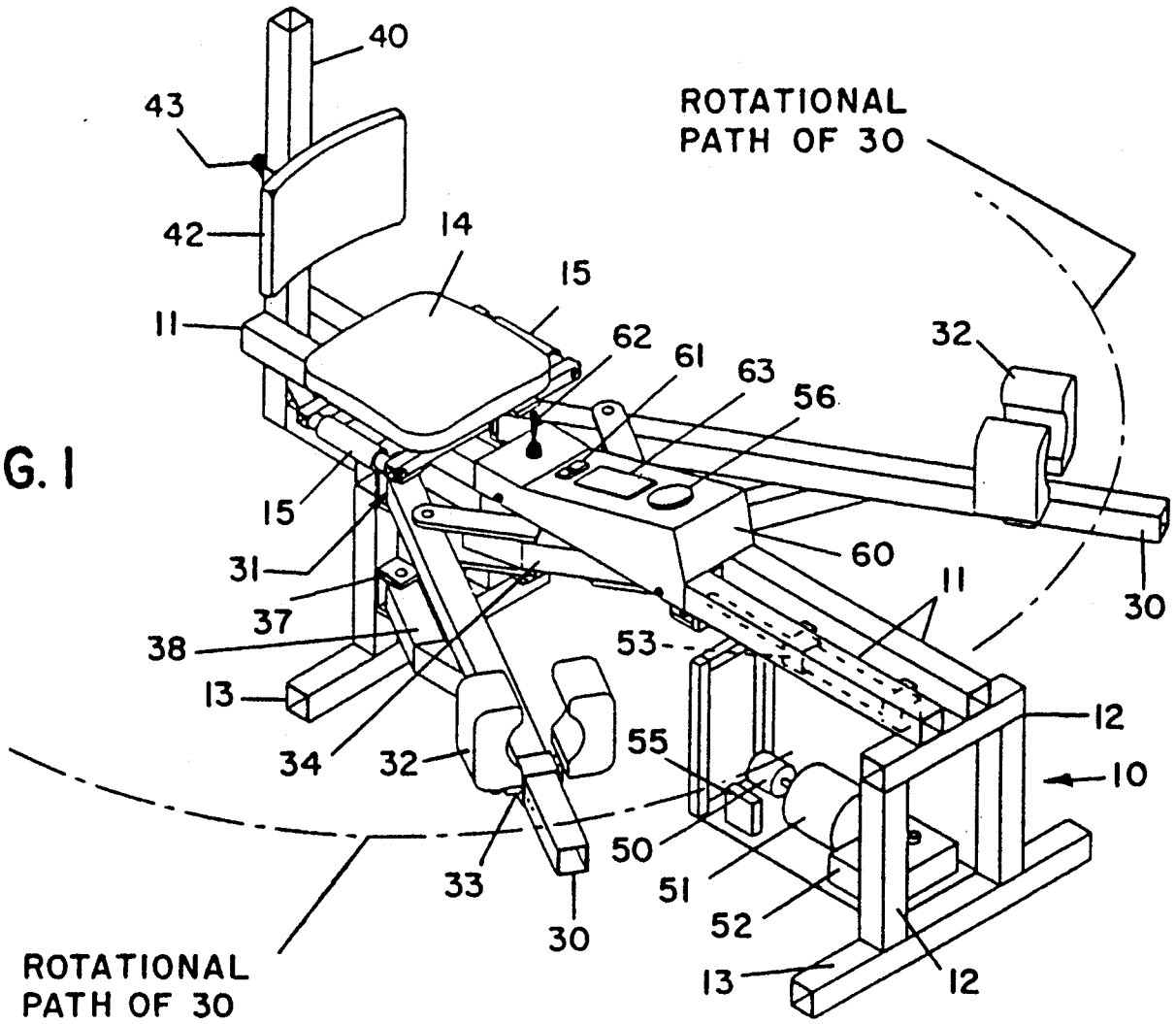
FIG. 1 is a perspective view of a preferred embodiment of the exercise machine of the present invention, designed for stretching hip adductor and back extensor muscles.

The following is a description, by way of example, of machines that can perform various stretching exercises, relating to various body parts. As discussed and illustrated herein, generally a specific machine or apparatus is designed for performing a stretching exercise on a specific body part, e.g. hip adductor muscles, trunk extensor muscles, hip extensor muscles, etc. Obviously it would be possible to design multi-purpose machines that are capable of performing a large range of stretching exercises on various body parts. Such machines can readily be designed by embodying the principles of the present invention, and can be adopted to the extent that their use is practical or desirable. However the machines illustrated in the drawings and described in the following are for reasons of clarity and simplicity shown as adapted to perform single or at most two stretching exercises.

EXAMPLE 1

Hip Adductor Stretch

Figure 2:
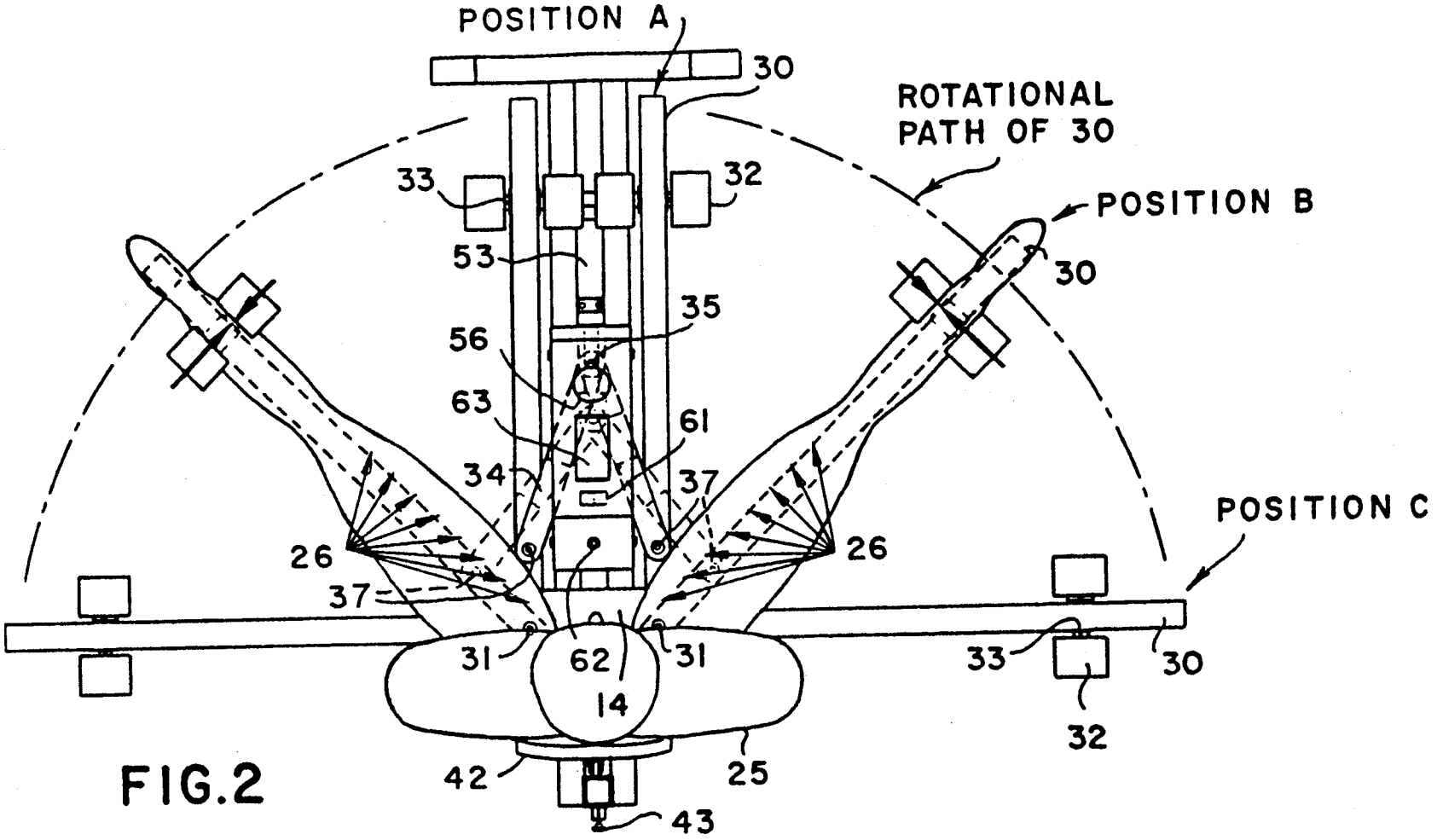
FIG. 2 is a plan view of the machine of FIG. 1, shown with a person seated in the machine and illustrating the hip adductor stretch.

Referring to FIGS. 1 and 2, the exercise machine consists of a frame, shown generally as 10, which has a longitudinal section 11, legs 12 and feet 13. Mounted on the longitudinal section 11 of the frame is a cushioned seat 14 which has handgrips 15 attached thereto at opposite sides.

Attached to the frame are two movable leg engagement member 30. Each leg members 30 consists of a horizontally extending elongated rod, pivotally attached to the frame by two vertically spaced hinges 31 and 37. Hinge 37 is attached to an arm 38 which is attached to the leg member 30. These connections thus allow angular movement of the leg engagement members in a horizontal plane shown in broken lines in FIG. 1. Referring to FIG. 2, movement is possible from position A, where the leg members are essentially side by side, through to position C, where the leg members form a 180° angle.

Each leg member 30 has cushioned pads 32 attached thereto which can be adjusted longitudinally of the member 30 by means of a position adjustor 33. This allows the pads 32 to be adjusted to accommodate the user's size.

The leg engagement members 30 are connected to a linear hydraulic actuator 53 by a toggle linkage 34 which is most clearly viewed in FIG. 2. The toggle linkage 34 is attached to each leg engagement member at hinge 37 and to the actuator 53 at hinge 35. The toggle is shown for two positions of the leg members, positions A and B in FIG. 2, which will be described below.

Figure 5:
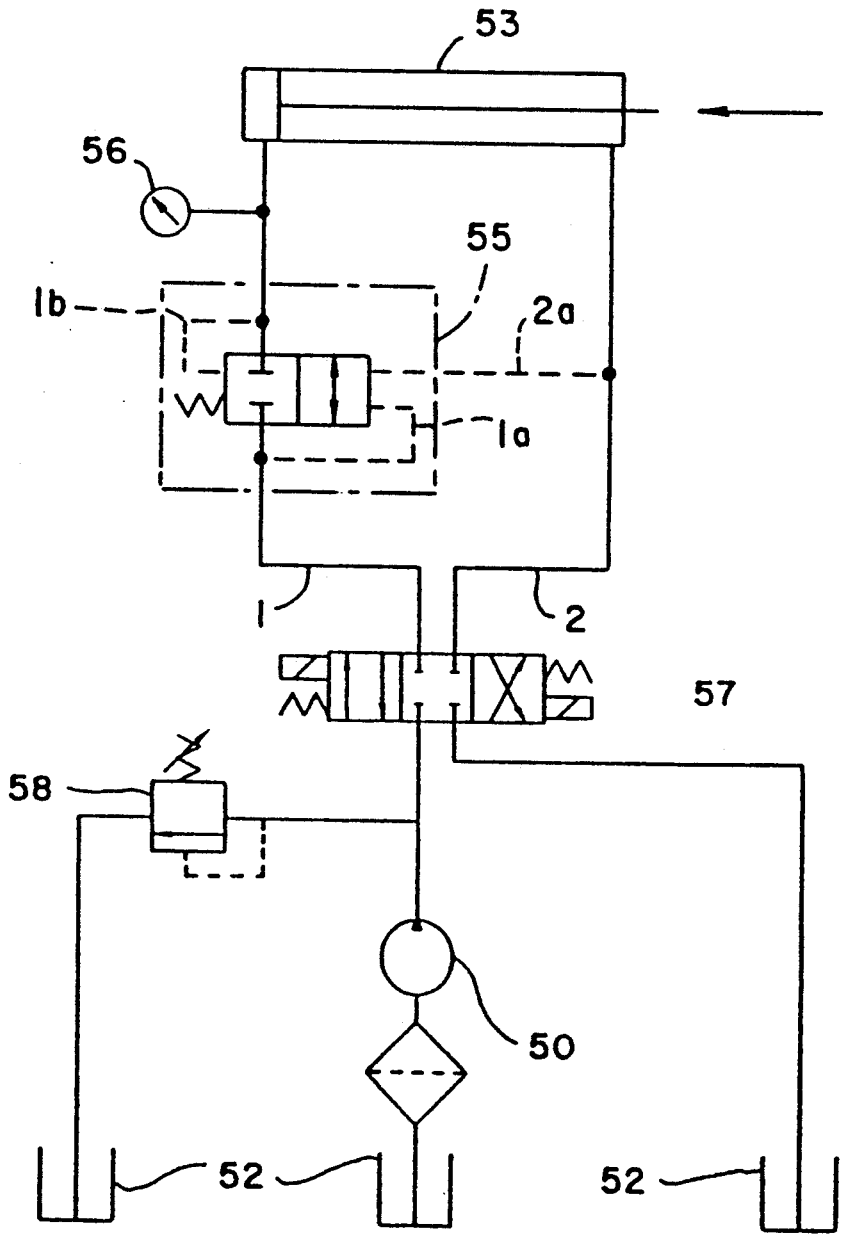
FIG. 5 is a schematic diagram showing the hydraulic power system of the exercise machine.

The linear actuator 53 is connected to a hydraulic power system that drives and controls the machine and is shown schematically in FIG. 5. The hydraulic system consists of the linear actuator 53, a pump 50, motor 51, a reservoir 52, a valve 55, a solenoid actuated directional control valve 57, a pressure gauge 56 and a pressure relief valve 58. The pump 50 draws fluid from the reservoir 52 and delivers it under pressure to one end or the other of the actuator 53 through lines 1 or 2 respectively, as controlled by the valve 57. The valve 55 is a check valve interposed in the line 1 between the control valve 57 and the left hand end of the actuator 53. As shown, valve 55 is normally spring biassed to a closed condition but is connected to pilot lines 1*a* and 2*a* through which pressure is applied to open the valve 55 whenever pressurized fluid is delivered to either of the lines 1 and 2.

The right position of the valve 57 thus directs fluid from the pump via line 1 to the left hand end of the actuator (while at the same time connecting the right hand end of the actuator via line 2 to the reservoir 52) causing the piston to extend and, through the toggle linkage 34, moves the leg engagement members away from each other, for example from Position A to Position B in FIG. 2. The left position of the valve 57 is essentially the reverse of the right position, wherein fluid is directed from the pump to the right hand end of the actuator and fluid is drained from the left hand end of the actuator to the reservoir 52. In this position the piston retracts and, through toggle linkage 34, pivots the leg engagement members towards each other, for example, from Position B to Position A in FIG. 2. The user can at all times, over-ride the machine power to assure that a safe exercise routine is enjoyed. This is ensured by the pressure relief valve 58 preset to a certain activating pressure, that is, set to a pressure that the user can easily resist. If the setting pressure is exceeded, fluid is directed back to the reservoir 52. The center or neutral position does not allow fluid to flow from the pump 50 to the linear actuator 53 and thus can lock the leg members at a predetermined position.

The machine also contains a control panel 60 attached to the frame above the longitudinal section 11 at a position within easy reach of a person seated on the seat 14. The control panel houses a power switch 61, a position selector 62, an angle indicator 63 and the pressure indicator 56.

The position selector 62 allows the user to select the position of the leg engagement members 30. The position selector 62 consists of a toggle switch that controls the position of the control valve 57. Therefore, the user can choose to move the leg members away from each other or together by choosing the left or right end positions of the valve, respectively, as previously discussed. The center position of the valve (illustrated in FIG. 5) will not allow movement in either direction. In this position, since the lines 1 and 2 are both unpressurized, the check valve 55 is spring biassed to its closed position. To ensure that it remains closed during exercising (and thus isolates the valve 57 from the relatively high pressures that can be generated in the left hand end of the actuator 53, as seen in FIG. 5, by the forces (represented by the arrow) generated by the user, a further pilot line 1*b* connects the actuator end of the line 1 to the check valve 55 so as to assist the spring in keeping the valve 55 closed.

Substitution of various other readily available known fluid system components for those shown in the drawings could enhance the performance of the system without departing from the scope of the invention. For example, it may be advantageous for the user to move the actuator in the direction opposite the arrow of FIG. 5 using his or her own power to spread the leg engagement members 30 apart with valve 57 in the neutral position. This can be achieved by using a directional control valve 57 with a slightly different internal spool configuration, which provides a path for fluid flow on the right hand side of the actuator back to the reservoir.

The pressure indicator 56 measures the pressure of the fluid in the hydraulic actuator when the user attempts to move the leg engagement members 30 together while the valve 57 is in the center position, where movement of the members is blocked. Thus the pressure indicator gives a pressure reading that is directly proportional to the force exerted by the user. A pressure gauge is the simplest way to measure the level of physical exertion of the user. The gauge in the present form is calibrated in pounds per square inch, but could be calibrated in pounds or kilograms or in arbitrarily defined units. For example the level of physical exertion could be measured on a scale from 1 to 10 or low, medium, and high. A more sophisticated way to measure the level of physical exertion, would be to use a pressure transducer attached to a hydraulic cylinder to sense pressure, and send the electrical information to a calibrated meter.

The components of the angular position measurement device or system are of the type commonly known and therefore are not shown in detail. The simplest way to measure angular position would be mechanically with a pointer on a backing plate with angular calibration. Movement of the pointer to indicate the angle of the horizontally extending elongated rod member 30 relative to the longitudinal machine frame 11 could be carried out with mechanical linkages, cables, or gears. An alternative and preferred method is to use an angular position sensor for providing an electrical output indicative of the relative angular position of the working member 30 with respect to the angular position of the machine frame 11. A simple method using this concept consists of a rotary resistor (potentiometer) in conjunction with a voltmeter calibrated in angular measuring. The voltage drop across the resistor correspond to the angular rotation of the potentiometer which in turn corresponds to the angle between the leg engagement members 30 and the longitudinal frame 11. For a half turn on the resistor the meter pointer (d'Arsonal movement type) would read a half scale deflection, therefore 45 degrees of rotation corresponds to a 50 percent voltage drop.

Another method readily available uses a printed circuit board with closely spaced "contacts" and a wiper to send an electrical pulse to an up/down counting module. Still another method would be to use a rotary optical transducer to send an electrical impulse to an up/down counting module. As an example, the printed circuit board would have 90 "contacts" to generate 90 pulses over an angle of 90 degrees when combined with a counting module which counts in increments of 1 degree. Similarly, a rotary optical transducer would send 180 electrical impulses over an angle of 90 degrees using a counting module with half degree increments.

Monitoring of the angular position could also be done using a position transducer in conjunction with a piston rod of a linear actuator or rotating machine member to sense relative position, with the position information data being sent to a microprocessor.

The preferred location of the angular sensing device is at hinge 37. As an example, a semicircular printed circuit board may be attached directly to member 30 with the wiper mounted in a fixed position on hinge 37. As member 30 is rotated about the hinge centerpoint, the wiper sends an electrical pulse to an up/down counting module each time a new contact is made.

The use of the machine to perform a hip adductor stretch will be described with reference to FIGS. 1 and 2. The user is shown generally as 25 and the hip adductor muscles are shown as 26. The user sits on the cushioned seat 14 and positions his legs in the cushioned pads 32 of the leg engagement members 30. The user can adjust the cushioned pads 32 by means of position adjustor 33. The machine is then turned on using the power switch 61 and the position selector 62 is operated to bring the engagement members 30 to the selected position. The user selects a position so that his legs are spread as far as possible (the knees can be straight or bent), without injuring himself, for example position B in FIG. 2. The angular position of the leg engagement members is indicated by the angle indicator 63. Once the position is set, the selector 62 is released so that the valve 57 reverts to its neutral position blocking the hydraulic circuit of the actuator 53 and thus retaining the members 30 in the selected angular position. In this blocked condition the hydraulic circuit of the actuator 53 is no longer exposed to the pressure generated by the pump 50 and is therefore unpressurized. With valve 57 in the neutral position, the flow of fluid delivered by the pump 50 is blocked causing enough pressure to develop to activate valve 58; thus directing fluid back to the reservoir 52. The user then tries to bring his legs together while the machine resists or blocks this movement thus resulting in isometric contraction of the muscle group. However the exertion generates pressure in the blocked hydraulic circuit. Feedback of the applied physical exertion is provided to the user by the pressure indicator 56.

After a given time, for example six seconds, the user operates the position selector 62 to spread his legs slightly further apart (concentric contraction). This action is lightly assisted by the hydraulic power system to move his legs to the new position. Although the method of providing light assistance after each isometric contraction is described in specific form (a hydraulic power system), it should be appreciated that other and further embodiments of the invention may be devised without departing from the basic concept thereof. As an example it may be preferable to use a pneumatic, a combination of pneumatic and hydraulic (air over-oil), or an electric motor actuator system. The exercise is then repeated for the new "lengthened" position Pressure is generated by the pump 50 to overcome the resistance to fluid flow. Resistance to flow in this application is due to constrictions in system components, mechanical friction losses, and fluid friction losses The user is not supposed to attempt to resist the movement of the actuator. An additional amount of light pressure is required by the pump to extend the actuator 53 to a new position as prescribed by the exercise technique. This is to assist the user in moving their limbs or body parts to the selected position. This new position is achieved due to the increased flexibility of the user. The relief valve 58 bypasses to the reservoir to keep the system pressure at a safe limit to prevent injury to the user.

The fluid check valve 55 isolates the directional control valve 57 from the pressure generated by the user to perform the isometric contraction. The pressure required to be generated by the pump is estimated to be only about 50 psi. On the other hand, the force (as indicated by the arrow in FIG. 5) the user exerts on the actuator rod generates a much higher pressure in the piston end of the cylinder. This pressure may be as high as 300 to 500 psi depending on the strength of the user. Since the directional control valve 57 is isolated from the pressure induced by the user, a valve with a relatively low position, spring centered solenoid activated directional control valve with a closed center spool configuration.

EXAMPLE 2

Trunk Extensor Stretch

Figure 3:
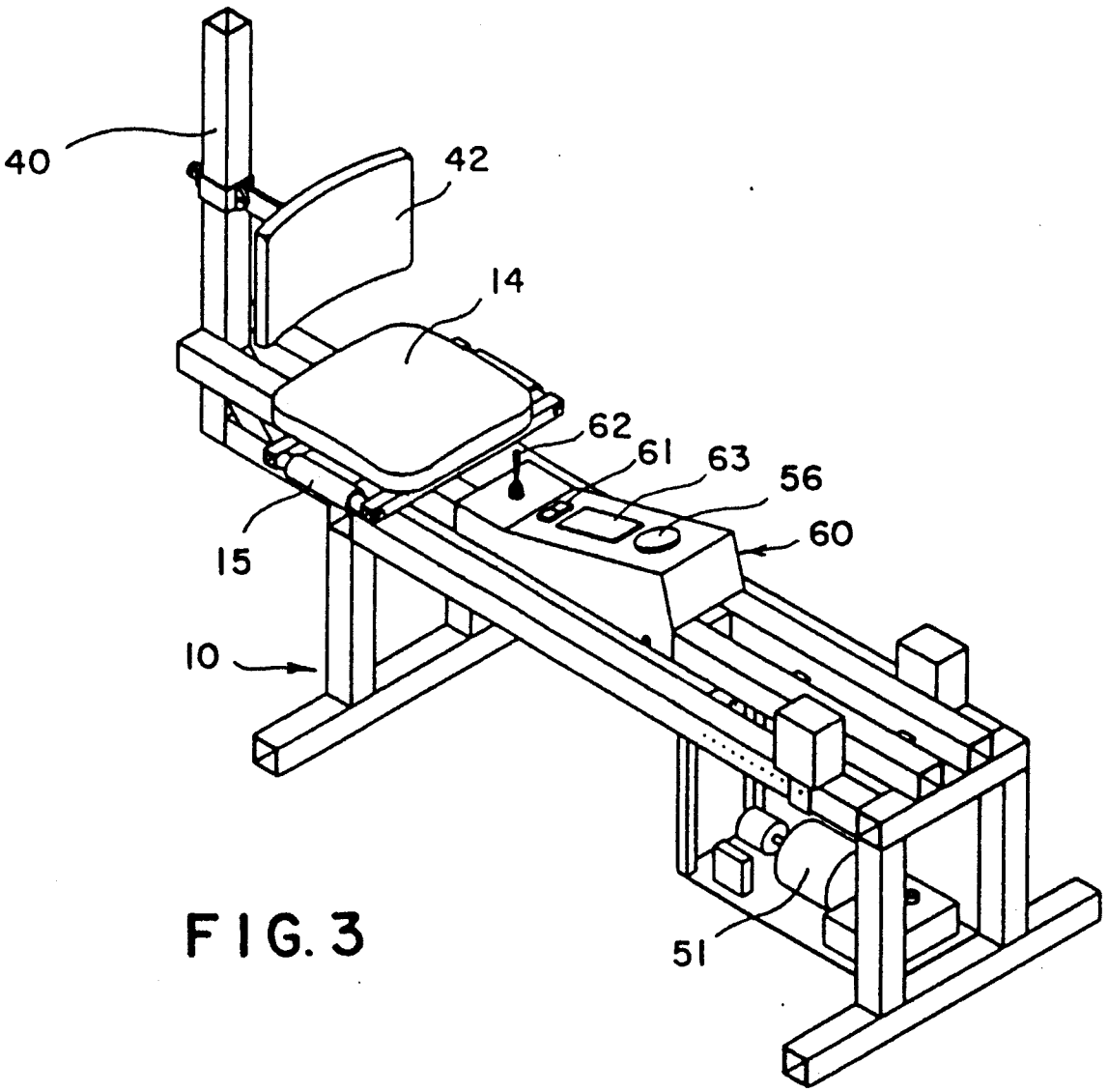
FIG. 3 is a perspective view of an embodiment designed for stretching back extensor muscles.
Figure 4:
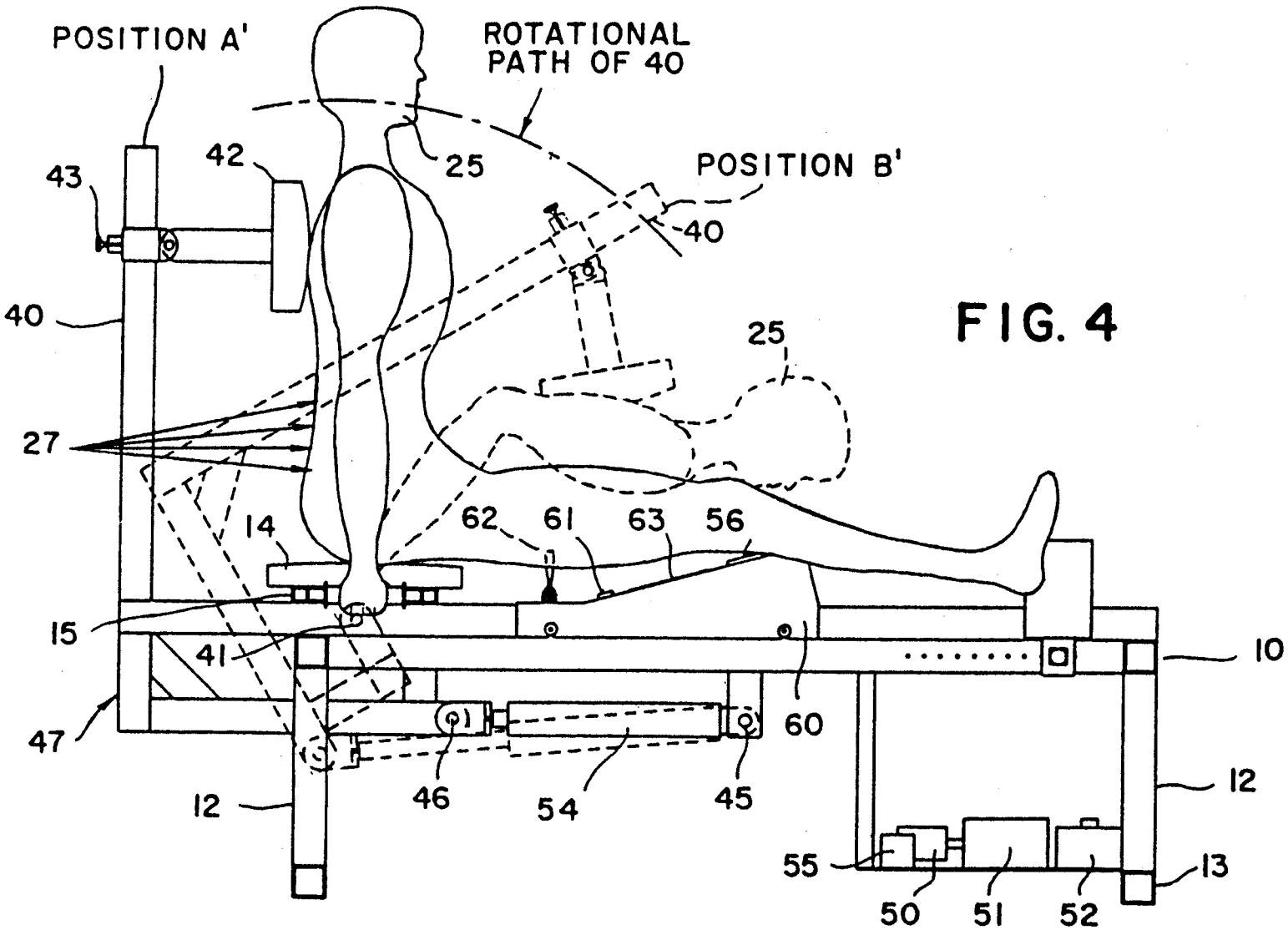
FIG. 4 is a side view of the embodiment of FIG. 3.

FIGS. 3 and 4 show an alternate embodiment of the machine, adapted to perform a trunk extensor stretch. In FIGS. 3 and 4 like numerals refer to like elements in FIGS. 1 and 2.

The exercise machine of this example contains a back engagement member 40, which is a vertically extending elongate rod pivotally attached to the frame at hinge 41 to allow movement in a vertical plane about a horizontal axis. FIG. 4 shows two positions of the back member, position A, wherein the back member is vertical and position B, wherein the back member is angled with respect to the frame 10. The back member 40 has a cushioned pad 42 attached thereto. The pad can be adjusted vertically by position adjustor 43 to accommodate the height of the user.

A linear actuator 54 is pivotally attached to the frame 10 at one end 45 and at its opposite end 46 is pivotally attached to a seat frame 47 that carries the seat 14 and the back engagement member 40 and is pivoted to the machine frame 10 at 41. It will be evident that from the position shown in full lines in FIG. 4, extension of the actuator 54 will cause the seat frame 47 to pivot (clockwise) the back engagement member 40 towards the position shown in broken lines, and vice versa. Actuator 54 is coupled to a hydraulic system which is essentially identical to the system of FIG. 5, as previously described.

The use of the machine to perform a trunk extensor stretch will be described. The trunk extensor muscle group is shown generally as 27.

The user 25 sits on the cushioned seat 14 with his legs forward and his back resting against the cushioned pad 42 attached to the back engagement member 40. The legs may be bent (flexed at knees) or straight (as shown). The height of the pad 42 is adjusted to a suitable position by use of the position adjustor 43. The user then flexes his trunk forward, as far as possible as shown by the broken outline in FIG. 4 (referred to as position B'). Movement of the engagement member 40 to the desired position is done using the position selector 62 as previously described, and the hydraulic circuit is then blocked. The angular position of the engagement member 40 is indicated by angle indicator 63. The preferred location of the angular sensing device is at hinge 41. In this case a semicircular printed circuit board is attached directly to back engagement 40 with the wiper mounted (not shown) in a fixed position on hinge 41. As member 40 is rotated about the hinge centerpoint, the wiper sends an electrical pulse to an up/down counting module each time a new contact is made. The user then tries to straighten up but the machine resists or blocks the movement since fluid cannot flow to or from the linear actuator 54 since the valve 57 is in the center position. Feedback of the level of physical exertion by the user is indicated by the pressure indicator 56. After a given time interval, for example six seconds, the user may increase the stretching of the trunk extensor muscles by pulling his trunk further toward his legs. Such further movement can be lightly assisted by the hydraulic power system, and in any case the member 40 is pivoted to keep the pad 42 in engagement with the back of the user. The exercise is then repeated for the new "lengthened" position.

EXAMPLE 3

Hip Extensor Stretch

Figure 6:
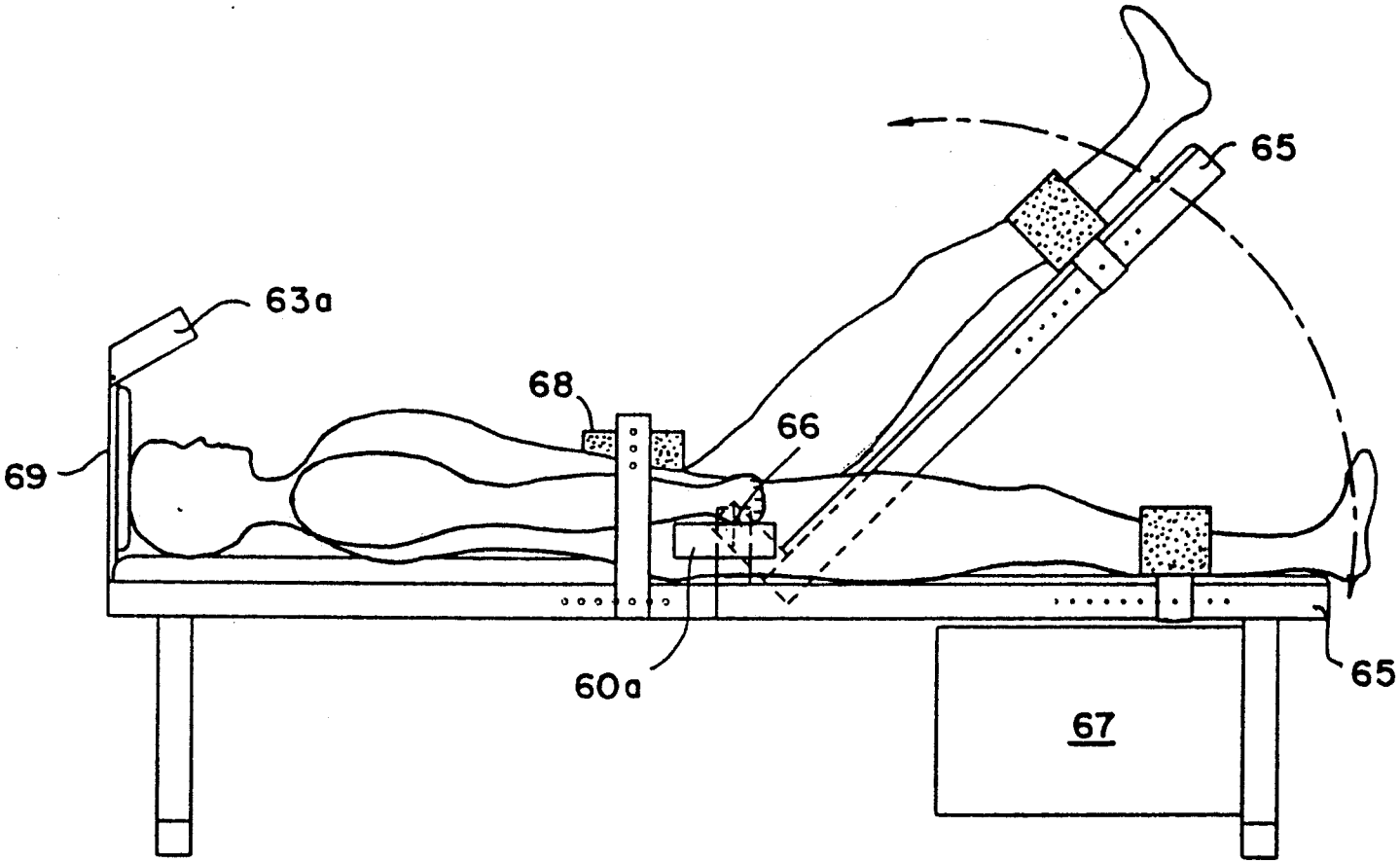
FIG. 6 is a side view of an embodiment of exercise machine designed for stretching hip extensor muscles.

FIG. 6 shows in side view an embodiment of machine designed for stretching the hip extensor or hamstring muscles. In this case leg engagement members 65 are mounted to pivot about a horizontal axis 66 and are controlled as before by a hydraulic actuator (not shown) driven by a power unit 67. The control panel 60*a* is positioned conveniently for operation by the user. An adjustable cushioned pad 68 is positioned to restrain upward movement of the trunk during exercising. A cushioned head rest 69 supports a display 63*a* that includes a pressure indicator and an angle indicator in a position for easy viewing by the user. The hydraulic circuit of this machine is the same as described previously and is used in the same way to perform the stretching, isometric contraction and concentric contraction steps of the exercise.

EXAMPLE 4

Plantar Flexor Stretch

Figure 7:
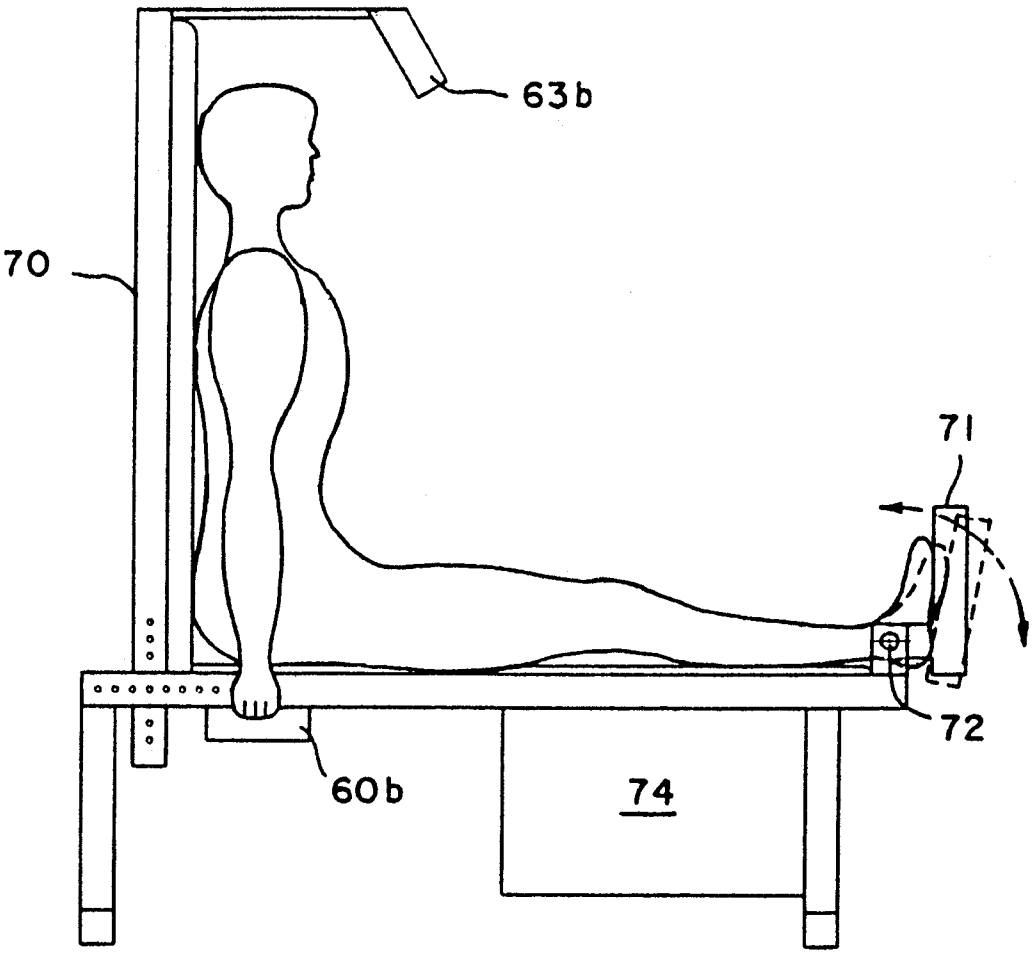
FIG. 7 is a side view of an embodiment of machine designed for stretching plantar flexor muscles.

FIG. 7 illustrates a machine designed for stretching exercise of the plantar flexor or calf muscles. Here an upright post 70 which provides back support for the user carries a display unit 63*b* for angle and pressure indication, and is adjustable both vertically and horizontally on the machine frame to suit the stature of the user. Also the user can perform exercises with knees bent, or straight (as shown).

One or two foot engagement members 71 are pivotable about a horizontal axis 72 on the machine frame, this axis corresponding generally to the location of the ankle joint of the user. As before, the engagement member 71 is pivoted to a linkage driven by a hydraulic cylinder from the power unit 74 controlled by the user from a control panel 60*b* positioned at a convenient location. The pivotal range of movement of the member 71 is indicated in broken lines.

EXAMPLE 5

Trunk Rotator Stretch

Figure 8C:
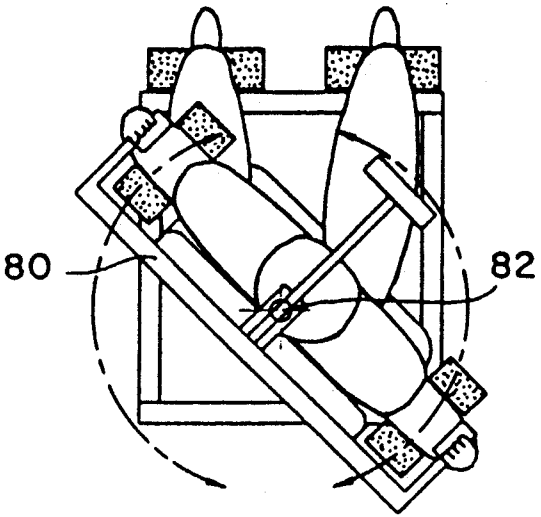
FIGS. 8A, 8B and 8C are schematic plan views of an embodiment of exercise machine designed for stretching trunk rotator muscles.
Figure 8B:
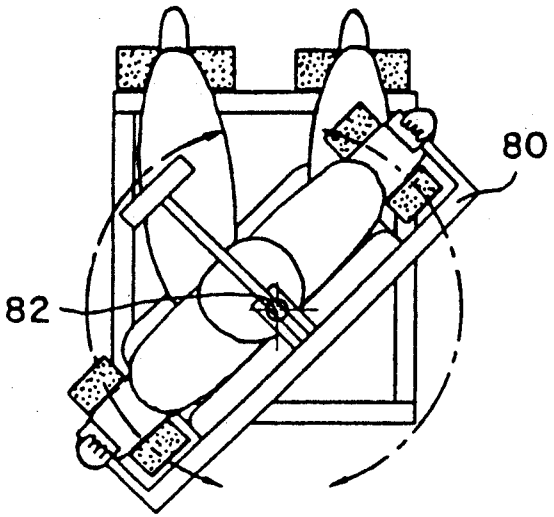
Figure 8A:
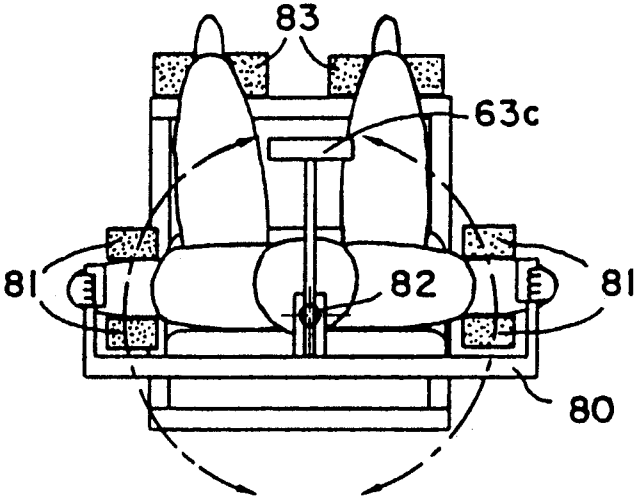

FIGS. 8A, 8B and 8C schematically illustrate a machine for trunk rotator stretch in which the user is located with the upper back against a rotating frame member 80, the trunk being engaged to the frame 80 by adjustable pads 81 for engaging each arm of the user. The rotating frame 80 pivots about an axis 82 as indicated by the arcuate broken lines, and a display unit 63c carried by the frame 80 is positioned in front of the user's face. Adjustable cushioned pads 83 engage the legs of the user to prevent movement of the pelvis during trunk rotation. Hydraulic cylinders (not shown) are connected to the rotating frame to effect a full range of rotation from the home position shown in FIG. 8A, through clockwise rotation as shown in FIG. 8B and counterclockwise rotation as shown in FIG. 8C.

EXAMPLE 6

Shoulder Horizontal Adductor Stretch

Figure 9C:
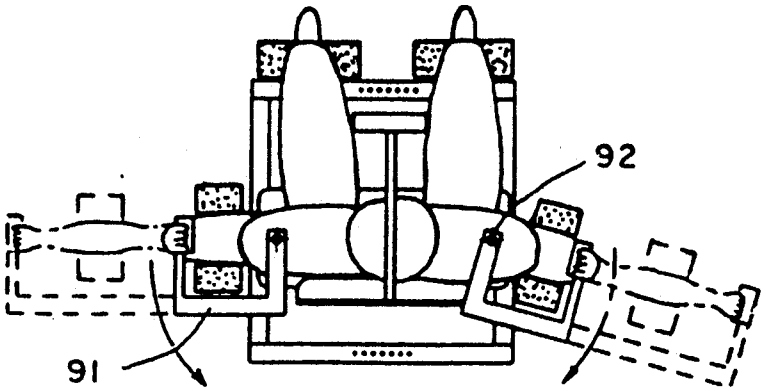
FIGS. 9A, 9B, 9C and 9D are schematic plan views of an embodiment of machine designed for stretching shoulder horizontal adductor muscles.
Figure 9D:
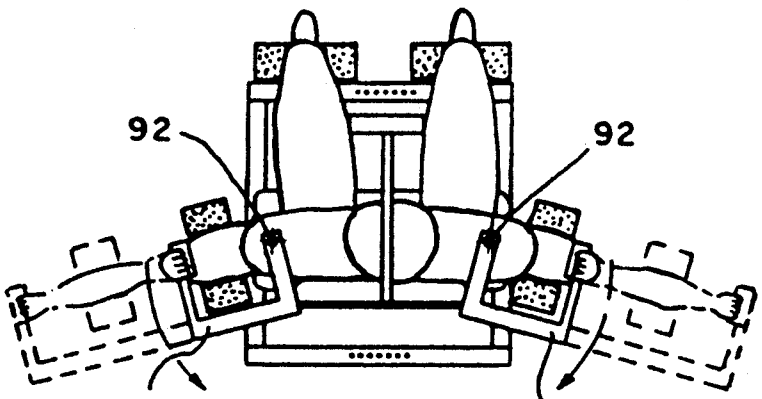
Figure 9B:
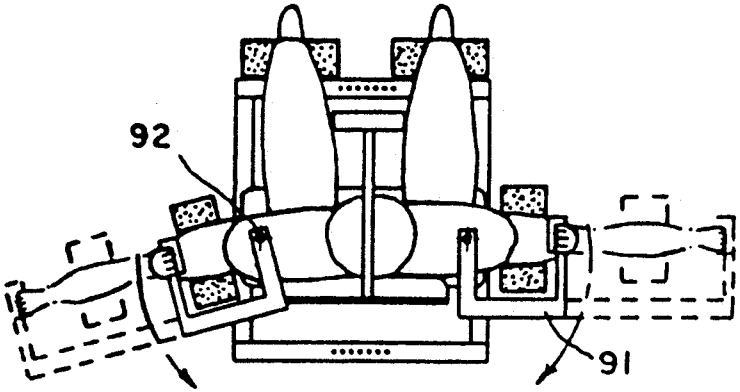
Figure 9A:
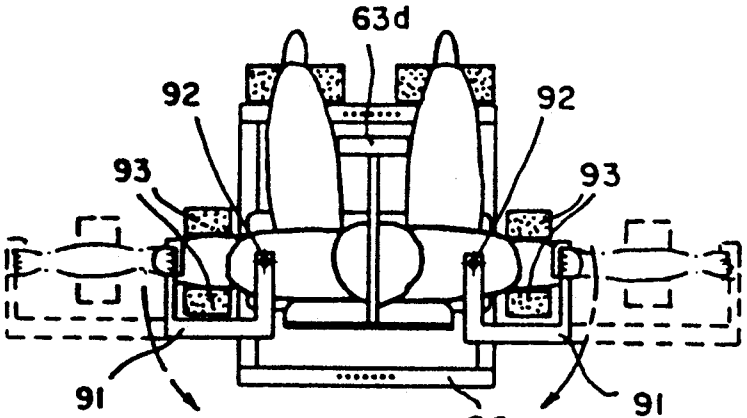

In FIGS. 9A through 9D the exercise machine is shown as having a stationary frame 90 on each side of which is an auxiliary frame 91 for engagement of the user's arms and pivoted about a vertical axis 92 for stretching of the horizontal adductor muscles indicated by the arrows on the front of the user in FIG. 9D. The auxiliary frame can preferably be adjusted for use with the user's arms bent at the elbow as shown in full lines, or straight at the elbow as illustrated in broken lines. As before, adjustable pads 93 engage the legs to maintain the remainder of the body motionless. A display **63*d* is positioned in front of the user's face. As before, hydraulic actuators (not shown) are coupled to the auxiliary frames 91 to control their pivotal movement about the axes 92 and thus apply the stretching exercise routines as described above to the shoulder horizontal adductor muscles. FIG. 9B shows the unit in use on the left shoulder; FIG. 9C shows it in use on the right shoulder; and FIG. 9D** shows the machine in use on both shoulders simultaneously.

EXAMPLE 7

Shoulder Internal Rotator Stretch

Figure 10B:
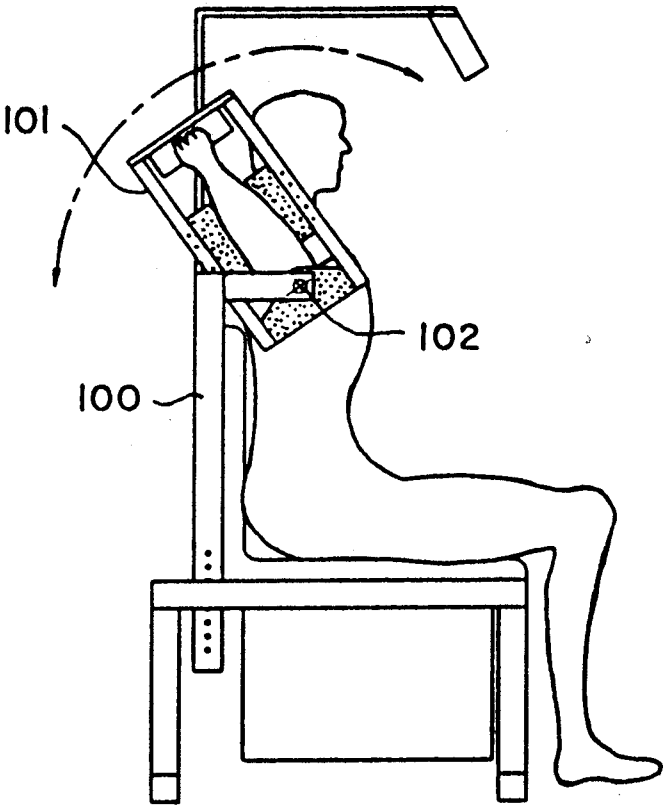
FIGS. 10A and 10B illustrate an embodiment of machine designed for stretching shoulder internal rotator muscles.
Figure 10A:
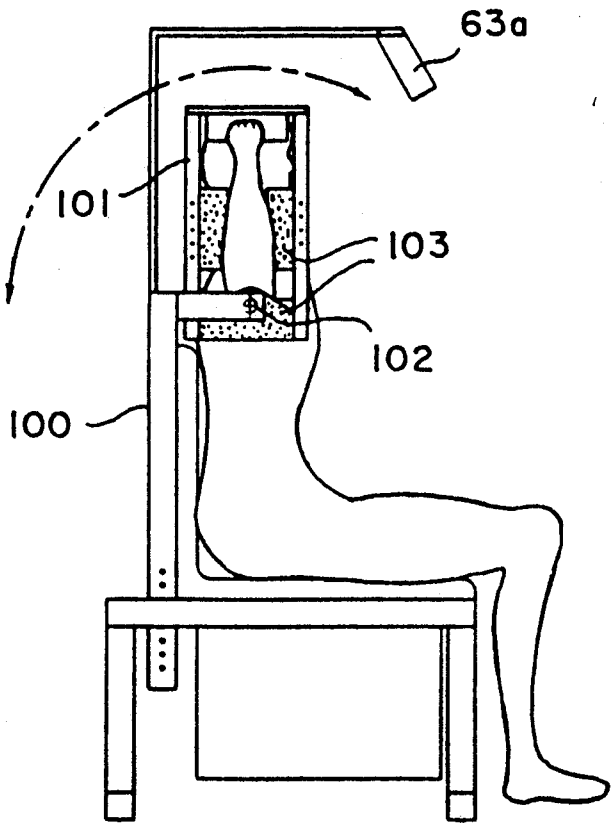

In the machine shown in FIGS. 10A and 10B, a vertically adjustable backrest post 100 has pivotally mounted thereon an auxiliary frame 101. The backrest post is vertically adjustable to align the pivot axis 102 of the frame 101 with the shoulders o the user. The frame 101 carries adjustable pads 103 to engage the form of the user, a control panel **63*a* being positioned for manipulation by the user's hand. Hydraulic actuator means (not shown) are coupled to the frame 101 to effect pivotal movement as indicated by the broken arcuate line and apply stretching to the shoulder internal rotator muscles. One such auxiliary frame 101** is provided on each side of the machine, and the control system is such that the two sides of the body can be exercised independently or in unison. Furthermore the configuration of the machine can be modified so that the exercise can be done by a user in the standing position.

EXAMPLE 8

Hip Flexor Stretch

Figure 11:
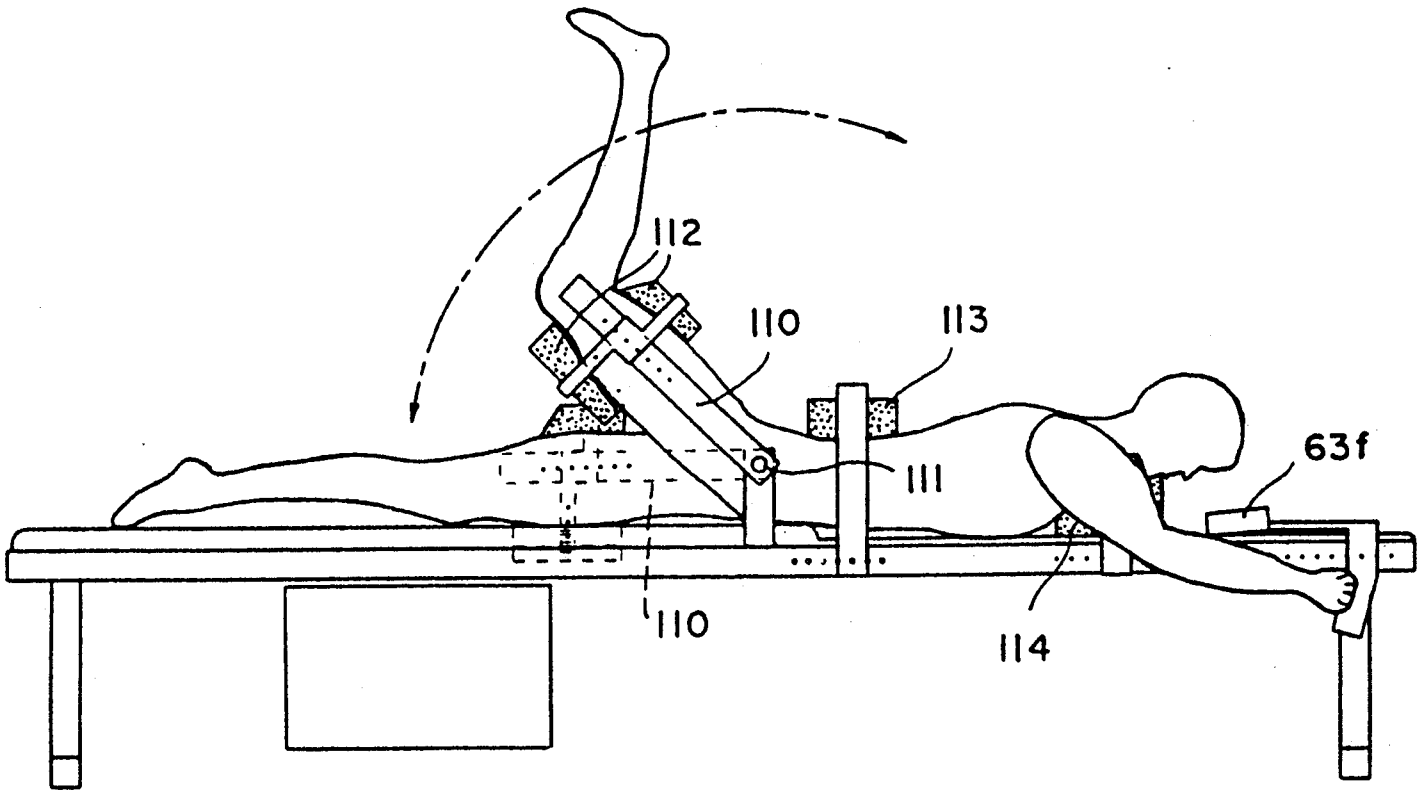
FIG. 11 shows an embodiment of machine designed for stretching hip flexor muscles.

In FIG. 11, the exercise machine is shown as including for each leg a leg engagement member 110 pivoted on a horizontal axis 111 that generally coincides with the hip socket of the user, the member 110 having adjustable pads 112 for engaging the thigh of the user close to the knee. A further cushioned pad 113 is positioned to engage the small of the back to restrict upward movement of the trunk, an additional cushioned pad being adjustably positioned beneath the shoulders of the user. As before hydraulic actuator means (not shown) are coupled to the leg engagement members 110 to effect pivotal movement thereof to apply stretching forces to the hip flexor muscles. The pad 114 can be adjusted as indicated by the arcuate broken arrow to raise the user's shoulders and thus apply a greater stretching effect to the hip flexor muscles. The left and right hand leg engagement members can be operated individually or in unison. One may be locked in the horizontal position (shown in broken lines) during stretching exercise applied through the one on the opposite side.

EXAMPLE 9

Trunk Lateral Flexor Stretch

Figure 12B:
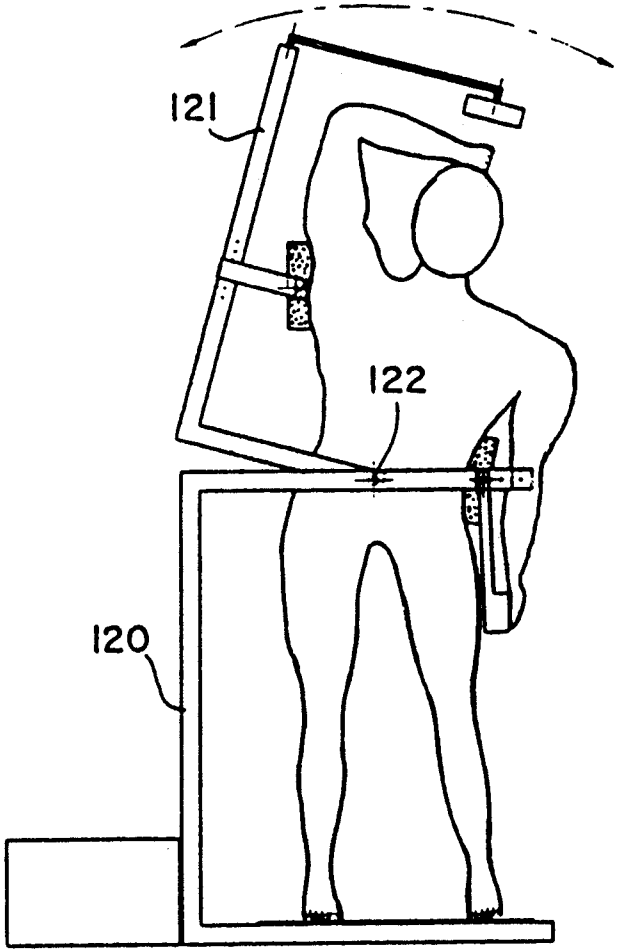
FIGS. 12A and 12B illustrate a machine designed for stretching trunk lateral flexors.
Figure 12A:
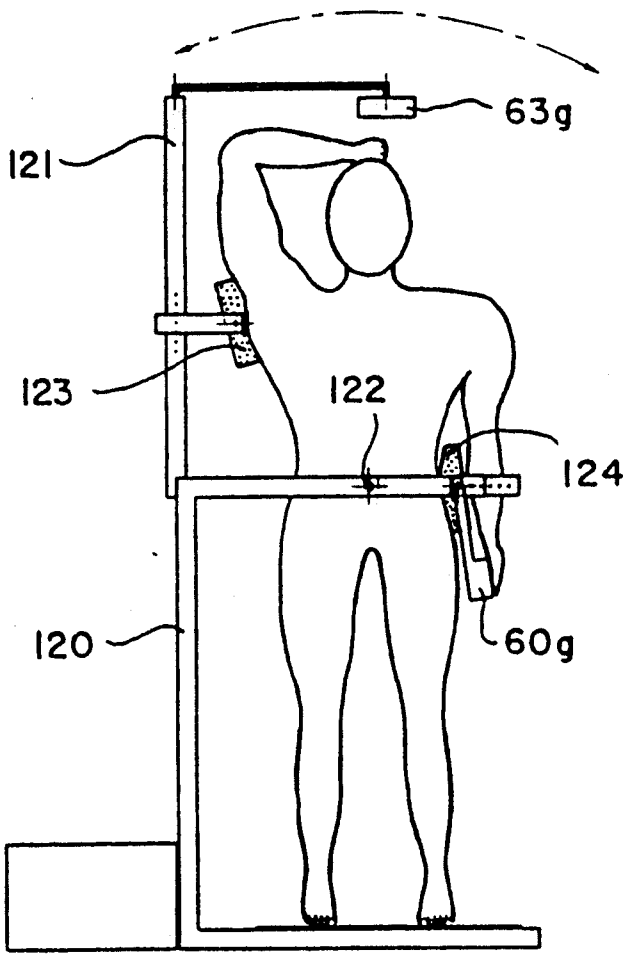

As shown in FIG. 12 a stationary frame 120 supports a movable frame 121 which can pivot about a horizontal axis 122 and which carries an adjustable cushioned pad 123 to engage a user's side in the shoulder region. The stationary frame carries an adjustable pad 124 to engage the opposite side of the user in the hip or waist region to prevent lateral movement of the user without however inhibiting lateral flexure. As before, hydraulic actuator means (not shown) are connected to the movable frame 121 to effect pivotal movement of the frame 121 and thus effect stretching of the trunk lateral flexor muscles, and also to provide the required resistance during isometric contraction of the muscles. A display **63*g* is positioned on the movable frame 121 at a location where it can be easily seen by the user, and likewise a control 60*g*** is carried on the stationary frame at a convenient location for manipulation by the user's free hand. The exercise machine can of course be used for lateral flexion of each side of the user's body, depending upon the direction in which the user faces.

While the above description refers to nine specific examples of stretching exercises that can be performed on machines of the present invention, it is to be appreciated that modifications to the machine can be made, in order to stretch other muscle groups or joints, without departing from the scope and spirit of the present invention. Obviously, selected elements from many of the above described exercise machines can be combined to provide composite or multi-purpose machines in which a variety of muscle groups can be stretched.

Several modifications have been described herein, and others will be apparent to those skilled in the art. Equivalent elements may be substituted for those specifically shown and described, certain features may be used independently of other features, and in certain cases particular locations of elements may be reversed or interposed, all within the inventive concept. Accordingly the present invention should be considered in terms of the following claims and is understood not to be limited to the details of the method and structures shown and described in the specification and drawings.

The embodiments of the invention in which an exclusive property or privilege is claimed are defined as follows:

1. A user controlled intermittent isometric stretching machine for stretching one or more muscle groups or joints of a body of a user in a plurality of positions, comprising:

a frame;

at least one restraint member movably mounted on said frame to engage a body part associated with the muscle group or joint that is to be stretched and to position such part at a desired location;

each said restraint member being displaceable under the control of the user through a predetermined range of movement with respect to said frame, movement in a first direction in said range being effective to apply through the body part a stretching force to the associated muscle group or joint;

angle indicator means positioned for viewing by the user to provide to the user a readout of the position of said restraint member in said range;

power means selectively operable by the user to effect movement of said restraint member in said first direction therefore assisting the user in further stretching in said plurality of positions;

blocking means selectively engageable by the user at any desired position in said range to support said restraint member against movement in a second direction opposite to said first direction therefore allowing the user to isometrically control the muscle group or joint that is to be stretched; and force measuring means operable when said blocking means is engaged to measure the force exerted by the body part upon said engagement member in said second direction.

2. The exercise machine according to claim 1 further comprising means to position said engagement member at a selected location in the predetermined range of movement.

3. The exercise machine according to claim 1 wherein said power means comprises a hydraulic actuator coupled in a hydraulic circuit with a pump, an electric motor and a reservoir.

4. The exercise machine according to claim 3 wherein the blocking means comprises means to prevent fluid flow from the hydraulic actuator.

5. The exercise machine according to claim 4 wherein said means to prevent fluid flow is a check valve located in the hydraulic circuit.

6. The exercise machine according to claim 3 wherein said force measuring means is a pressure gauge located in said hydraulic circuit.

7. The exercise machine according to claim 1 wherein each said engagement member contains an adjustable cushioned pad for contact with the body part associated with the muscle group to be stretched.

8. The exercise machine according to claim 1 wherein there are two engagement members extending horizontally from the machine adapted for engaging the legs of a user.

9. The exercise machine according to claim 1 wherein there is one engagement member extending vertically from the machine adapted for engaging the back of the user.

10. The exercise machine according to claim 1 wherein a pair of engagement members are provided each pivotable about a common horizontal axis and engageable with a leg of the user.

11. The exercise machine according to claim 1 wherein at least one engagement member is provided to pivot on a horizontal axis and to engage the foot of a user.

12. The exercise machine according to claim 1 wherein said engagement member comprises a first support frame having means for engaging the upper arms of a user, said first support frame being mounted for rotation about an axis generally adapted to correspond to the position of the spine of a user engaged in the frame.

13. The exercise machine according to claim 1 wherein said engagement member is carried on a second support frame that is adapted to locate the body of the user in a substantially stationary condition, said engagement member being adapted to engage an arm of the user and being mounted to pivot on the frame on an axis that in relation to the user's body is upright and adapted to coincide with the user's shoulder joint.

14. The exercise machine according to claim 1 wherein said engagement member comprises an auxiliary frame that is adapted to engage the forearm of a user and rotate it about an axis that with respect to the user is horizontal and aligned transversely at shoulder height.

15. The exercise machine according to claim 1 wherein said at least one engagement member is adapted to engage the thigh of a user, and to rotate about an axis that, in relation to a body positioned on the frame is transversely aligned with the hip joint.

16. The exercise machine according to claim 1 wherein said engagement member is adapted to engage a lateral side of the trunk of the user and to pivot with respect to the frame about an axis that is horizontal in the front to back direction and centrally located with relation to the waist of a user positioned in the frame.

17. The stretching machine according to claim 1 wherein said angle indicator means, said power means and said blocking means are positioned on the frame of said machine in a location that is readily accessible to the user during use of the machine.

18. The stretching machine according to claim 1 wherein said power means comprises a hydraulic actuator coupled in a hydraulic fluid circuit adapted to be pressurized by a motor driven pump, said blocking means comprising valve means which when actuated prevents fluid flow from said hydraulic actuator, and force measuring means comprising a pressure transducer located to measure the force exerted by the body part as a function of the pressure generated in said hydraulic circuit through interaction of the body part with the associated restraint member.

19. A stretching machine according to claim 1 further including adjustable force limiting means for selectively limiting the force that can be exerted by the body part through said restraint member.

20. A stretching machine according to claim 18 further including adjustable force limiting means for selectively limiting the force that can be exerted by the body part through said restraint member, and wherein said force limiting means comprises a pressure relief valve in said hydraulic fluid circuit.

* * * * *

UNITED STATES PATENT AND TRADEMARK OFFICE

CERTIFICATE OF CORRECTION

PATENT NO. : 5,277,681

DATED : January 11, 1994

INVENTOR(S) : Laurence E. Holt

It is certified that error appears in the above-indentified patent and that said Letters Patent is hereby corrected as shown below:

Column 11, line 20, change "control" to --contract--.

Signed and Sealed this

Twenty-fifth Day of October, 1994

*Attest:*

Bruce Lehman

BRUCE LEHMAN

*Attesting Officer*

*Commissioner of Patents and Trademarks*